United States Patent [19]

Ssinegurski et al.

[11] 4,059,075

[45] Nov. 22, 1977

[54] BUCKSTAY ARRANGEMENT

[75] Inventors: Eugen Ssinegurski, Simsbury; Donald Wilkinson, West Hartford, both of Conn.

[73] Assignee: Combustion Engineering, Inc., Windsor, Conn.

[21] Appl. No.: 739,898

[22] Filed: Nov. 8, 1976

[51] Int. Cl.[2] ..... F22B 37/24

[52] U.S. Cl. ..... 122/6 A; 122/510

[58] Field of Search ..... 122/6 R, 6 A, 494, 510

[56] References Cited

U.S. PATENT DOCUMENTS

| | | | |
|---|---|---|---|
| 3,277,870 | 10/1966 | Reale | 122/6 A |
| 3,301,225 | 1/1967 | Boe et al. | 122/510 |
| 3,373,721 | 3/1968 | Sheikh | 122/6 A |
| 3,814,063 | 6/1974 | Bijmholt | 122/6 A |

*Primary Examiner*—Kenneth W. Sprague

*Attorney, Agent, or Firm*—Wayne H. Lang

[57] ABSTRACT

A buckstay arrangement for a steam generator whereby tube walls of the steam generator are supported by buckstays having retainers that slide longitudinally to permit thermal expansion thereof while providing continuous support for the tube walls.

6 Claims, 3 Drawing Figures

BUCKSTAY ARRANGEMENT

BACKGROUND OF THE INVENTION

Steam boiler plants are commonly constructed of gas tight tube banks forming walls supported on the outside thereof by a buckstay arrangement of flanged girders that extend around the boiler to prevent "dishing" of the walls as effected by a differential of pressure. Although a certain amount of thermal expansion of the tube walls is permitted with existing apparatus, the tube walls together with the buckstays frequently become over-stressed and fail because of a positive connection therebetween. Some arrangements with a sliding support as shown by U.S. Pat. No. 3,301,225 have been developed; however, in such an arrangement the sliding support permits restricted longitudinal movement only, while welded connections preclude other movement. Other arrangements exemplified by U.S. Pat. No. 3,203,376 have been developed whereby the forces exerted on the tube walls are transmitted to the surrounding buckstays by a combination of positive connections and pivotal linkages. Although such arrangements have been considered satisfactory for small furnaces that operate at low pressures, they lack flexibility, they are slow to construct, they require an excessive amount of handwork to assemble and to adjust, and they are, consequently, quite expensive to install and use.

SUMMARY OF THE INVENTION

In accordance with the present invention, an improvement is provided on an arrangement by which the tube walls of a boiler are both pivotally and slidably supported by a surrounding buckstay arrangement that comprises horizontally disposed flanged girders extending completely around the boiler.

The improvement of the invention specifically comprises an angled runner carried by the boiler wall and slidably abutting each buckstay to provide a continuous support for furnace walls that precludes "dishing" as a result of excessive positive or negative pressure within the furnace, while permitting relative horizontal movement and limited vertical movement. The angled runner is also formed with a convex surface that lies in contact with the flanged buckstay to permit relative pivotal movement therebetween.

The present invention results in a significant simplification of the arrangement by which the boiler walls are supported by a structural support member, it requires but a minimum number of manhours assembly time while it affords maximum support throughout a wide range of temperature and pressure, and all manufacturing operations may be performed in a central manufacturing shop and only final assembly is required at an installation site.

BRIEF DESCRIPTION OF THE DRAWING

The nature of my invention and its novel features will be more fully understood from the following description and shown in the accompanying drawings in which.

DESCRIPTION OF THE PREFERRED EMBODIMENT

Figure 1:
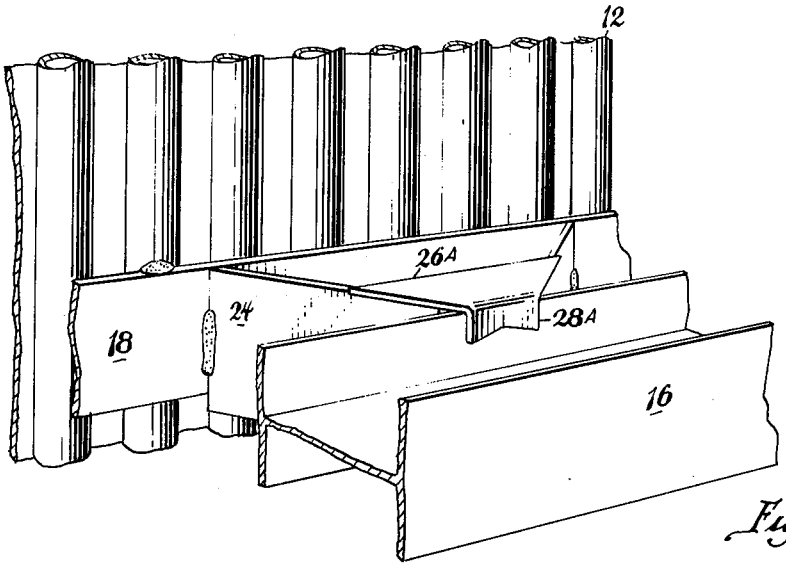
FIG. 1 is a fragmentary perspective of an assembled apparatus incorporating the present invention.
Figure 2:
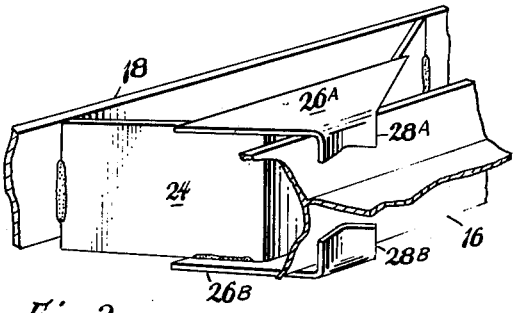
FIG. 2 is a perspective view showing a buckstay arrangement embodying the principles of the present invention.
Figure 3:
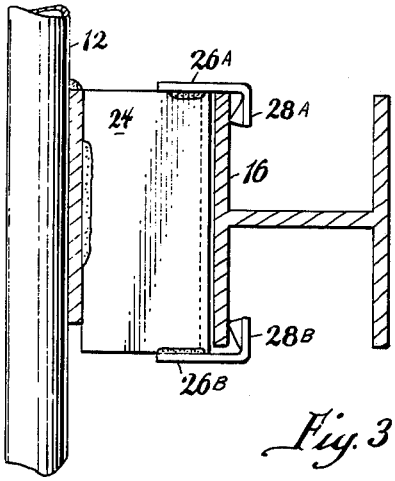
FIG. 3 is a cross-sectional view of the apparatus of FIG. 2.

Referring to the drawings there is shown a boiler-furnace comprising a series of vertically spaced tubes 12 that comprise the outer tube walls of a combustion chamber. The walls of the combustion chamber are supported against positive or negative pressure within the combustion chamber by a buckstay arrangement 16 that extends horizontally around the furnace at a series at vertically spaced intervals and includes a series of brackets that extend between the tube walls and the buckstays. The brackets are adapted to embrace the buckstays to preclude deflection or "dishing" of the tube walls caused by excessive positive or negative pressure within furnace. As the furnace walls expand or contract, the brackets slide along the flanges of the buckstays to permit relative movement therebetween caused by thermal expansion and contraction of the tube walls.

There are one or more brackets positioned between each buckstay and an adjacent section of the tube walls, all of which are of similar construction and adapted to provide a similar movable support.

Each bracket comprises a tie plate 18 welded horizontally around the periphery of the tube walls that comprise the boiler furnace. The tie plate 18 provides an elongate base for a "U-shaped" support plate 24 lying on a side edge thereof and extending horizontally outward from the tie plate 18 to the space adjacent the face of a vertical flange of buckstay 16. An angular runner having a horizontal flange 26A is then welded to the edge of the "U-shaped" support plate 24 to bridge the bight thereof while flange 28A thereof extends vertically down along the inner surface of the outer flange of buckstay 16 in sliding relation thereto. An angular runner with a horizontal flange 26B is welded to the lower edge of "U-shaped" support plate 24 so that the vertical flange thereof extends upward along the inner face of the flange for buckstay 16 to provide a sliding contact therewith. Together the flanges 28A and 28B thus slide against the inside face of the flange for the buckstay to prevent inward deflection of the tube wall, while the outside of the buckstay flange lies closely adjacent the bight portion of "U-shaped" support plate 24 to prevent outward deflection of the tube wall.

Accordingly, each vertical flange 28A and 28B is formed with a slightly convex surface that readily slides against the plane surface of flange 16 and produces only a minimum amount of contact therebetween. Thus, frictional resistance between vertical flanges 28A and 28B and the adjacent surfaces of flange 16 will be held to a minimum, and the convex surface will provide a pivot point about which the boiler walls may distort relative to the adjacent buckstays to provide a wide latitude of movement therebetween. A still further advantage of the device of the present invention is that it is adapted to be completely constructed in a central shop and only assembled in the field under less than ideal conditions to afford maximum efficiency together with maximum flexibility of operation.

Inasmuch as shop produced parts, welds, and other construction features are effected with greater accuracy and efficiency than those made in the field, and an improved product is produced at a reduced cost. Moreover, the unique angular retainer provides support for the boiler walls throughout a wide range of pressure and temperature fluctuation within the boiler.

Although this invention has been described with reference to the attached drawing, it will be obvious that various changes and modifications may be made without departing from the spirit of the invention. Therefore, the details of the invention are to be limited only by the scope of the appended claims.

We claim:

1. A steam generating unit having a rectangular furnace comprised of vertical walls formed by a series of adjacent upright tubes, a buckstay arrangement of horizontal beams extending transversely around the vertical walls of said furnace in spaced arrangement to provide a support therefor, means slidably connecting the vertical tubes of said wall to the buckstay arrangement comprising a tie plate secured to said tube wall including a first flange extending horizontally outward therefrom toward the adjacent buckstay, and an angular retainer having a horizontal flange thereof secured to the first horizontal flange and a vertical flange thereof arranged to slidably embrace an outer surface of said buckstay, said vertical flange being bent to present a convex surface that slidably abuts said buckstay to permit pivotal movement therebetween.

2. A steam generating unit as defined in claim 1 wherein the vertical flange of the angular retainer is formed with a surface that is bent about a vertical axis to present a minimum line of contact between an outer vertical wall of the buckstay and the angular retainer.

3. A steam generating unit as defined in claim 2 wherein the line of contact between the angular retainer and the outer surface of the buckstay lies normal to a line defining the horizontal expansion of the tube wall.

4. A steam generating unit as defined in claim 3 wherein said tie plate comprises a horizontal U-shaped channel member having a web portion thereof bonded to the tube wall and upper and lower flanges thereof extending horizontally outward toward upper and lower edges of the horizontal beams that comprise the buckstay.

5. A steam generating unit as defined in claim 4 including a second angular retainer having a horizontal flange thereof bonded to the lower flange of the tie plate and a vertical flange integral therewith slidably embracing a vertical surface of said buckstay.

6. A steam generating unit as defined in claim 5 wherein the first and second angular retainers are disposed symmetrically on opposite sides of the buckstay to provide a bracket arrangement slidably holding the buckstay therebetween.

* * * * *